US005983458A

United States Patent [19]

Jackson

[11] Patent Number: 5,983,458

[45] Date of Patent: Nov. 16, 1999

[54] LOCKING CLASP

[75] Inventor: Terry R. Jackson, Bozeman, Mont.

[73] Assignee: OP/TECH, USA, Inc., Belgrade, Mont.

[21] Appl. No.: 09/112,052

[22] Filed: Jul. 9, 1998

[51] Int. Cl.[6] ..... A44B 21/00

[52] U.S. Cl. ..... 24/3.12; 24/67.5; 24/67.7; 24/170

[58] Field of Search ..... 24/3.12, 67.5, 24/67.7, 573.3, 573.5, 573.6, 662, 163 K, 170

[56] References Cited

U.S. PATENT DOCUMENTS

| | | | |
|---|---|---|---|
| 0,405,596 | 6/1889 | Petsche | 24/67.5 |
| 1,304,403 | 5/1919 | Storch et al. | 24/3.12 |
| 1,403,907 | 1/1922 | Maxwell | 24/67.7 |
| 2,463,451 | 3/1949 | Yates | 24/67.5 |
| 3,597,813 | 8/1971 | Takahashi | 24/67.5 |
| 4,562,618 | 1/1986 | Masuda | 24/67.7 |

FOREIGN PATENT DOCUMENTS

| | | | |
|---|---|---|---|
| 0521373 | 7/1921 | France | 24/67.7 |

*Primary Examiner*—Victor N. Sakran
*Attorney, Agent, or Firm*—Pillsbury Madison & Sutro LLP

[57] ABSTRACT

A belt clasp has a supporting body with a top portion, back side, and an inner perimeter defining a slot. A clasping arm is flexibly attached to the top portion of the supporting body and extends into the slot area. Two extensions extend from the back supporting side, each defining an engaging groove. A locking unit is provided with a locking portion and an engaging rod, which pivotally engages the grooves. The locking portion is shaped to prevent the clasping arm from opening in the locked position, and in the unlocked position, the clasping arm may be opened and the belt removed from the belt clasp.

15 Claims, 2 Drawing Sheets

LOCKING CLASP

FIELD OF THE INVENTION

The present invention relates generally to a belt clasp and specifically to a locking belt clasp with a mechanism for locking the clasp to a belt.

BACKGROUND INFORMATION

Conventional belt clasps frequently have a tongue-shaped belt engaging member that slips over a belt or other such structure. The belt clasps are typically attached to a storage unit such as a pouch, canteen or knife holder. Securing the storage unit to a belt with the belt clasp provides the advantage that the storage unit is readily accessible to the user. However, having the storage unit on a belt subjects it to being knocked in various directions as the user moves about. Accordingly, conventional belt clasps easily disengage from the belt when jostled or forced in certain directions causing the user to lose the storage unit and the objects therein.

SUMMARY OF THE INVENTION

What is needed in the art is a belt clasp having a locking mechanism that prevents the clasp from slipping from the belt once the locking mechanism is engaged. The present invention is directed to solve this need.

It is an object of the present invention to provide a belt clasp that has a locking mechanism whereby the clasp may be locked and prevented from separating from the belt.

It is another object of the present invention to provide a locking belt clasp which is economical to manufacture.

It is another object of the present invention is to provide a locking belt clasp that is easy to operate.

The present invention comprises a locking belt clasp that has a supporting body with a top portion and bottom portion, a front supporting surface, a back side, and a bottom surface. The supporting body has an inner perimeter which defines a slot. A clasping arm having an attaching end and a distal end is flexibly attached to the front supporting surface which is located in the top portion of the supporting body. The distal end of the clasping arm extends into the slot. The clasping belt is formed of a resilient material which allows the clasping arm to flex as needed without breaking.

To slip the clasp onto a belt, the clasping arm is flexed open to provide space through which to insert the belt. The clasping arm and supporting body are formed such that in the natural or unflexed position the clasping arm extends away from the supporting body and then arches back towards and into the slot. This configuration forces the clasping arm against the belt held by the clasp and thus holds the clasp to the belt.

The supporting body comprises a back side having a first and second extension, each defining a first and second engaging groove, respectively. A locking unit is provided having an engaging rod and a locking portion. The engaging rod has first and second engaging ends and is shaped such that both engaging ends are pivotally engaged in first and second engaging grooves, respectively. This arrangement enables the locking unit to have a locked position and an unlocked position.

Once a belt or object is positioned in the locking clasp, the locking unit may be pivotally rotated to the locked position. Specifically, the locking portion of the locking unit is rotated to be located over the distal end of the clasping arm. In this configuration, if the clasping arm is forced or flexed open, it is stopped by the locking portion of the locking unit and thus prevented from opening sufficiently to allow the belt to escape. The belt is thus locked in the belt clasp. The locking unit may then be pivoted to the unlocked position where the locking portion moves away from the distal end of the clasping arm so as to allow the clasping arm to flex open and allow the belt clasp to be released from the belt.

The locking portion has a guidance flange extending from the locking portion. The guidance flange is shaped so as to provide stability to the locking unit by engagement with the bottom surface of the supporting body when the locking unit is in the unlocked position.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE INVENTION

Figure 1:
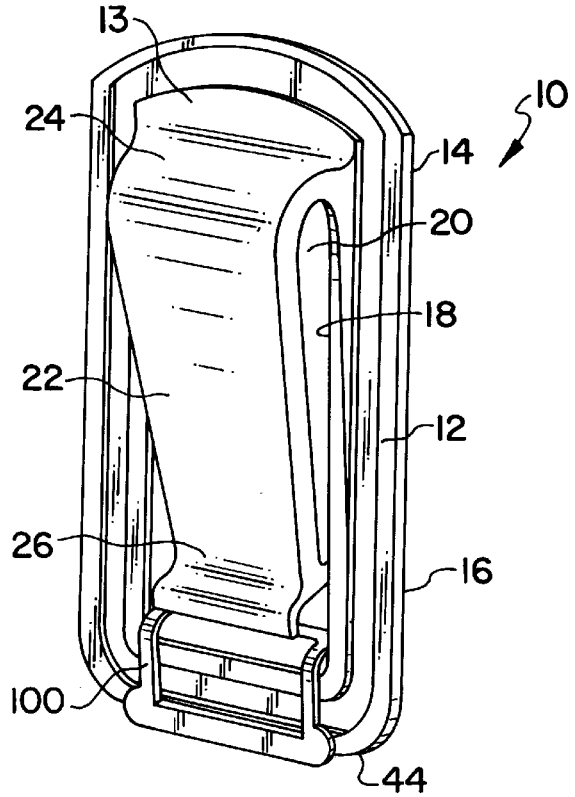
FIG. 1 is a plan view of the front side of the unlocked clasp.

A typical embodiment of the invention is disclosed in FIGS. 1–5. Referring first to FIG. 1, the locking clasp 10 has a supporting body 12 having a top portion 14, a bottom portion 6, a back side 9 (not shown), a bottom surface 44, and an inner perimeter 18 which defines a slot 20 in the supporting body 12. A clasping arm 22 has an attachment end 24 and a distal end 26. The attachment end 24 is flexibly attached to the front supporting surface 13 in the top portion 4 of the supporting body 12. The distal end 26 of the clasping arm 22 extends into the slot 20.

Figure 2:
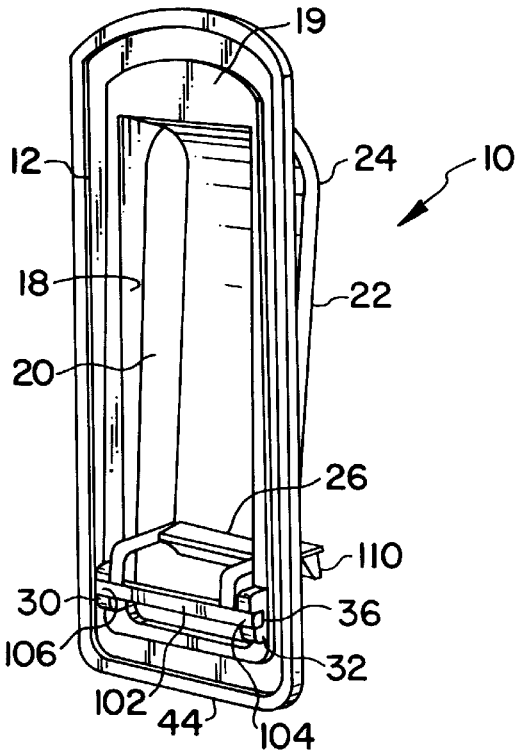
FIG. 2 is a plan view of the back side of the locking clasp.
Figure 5:
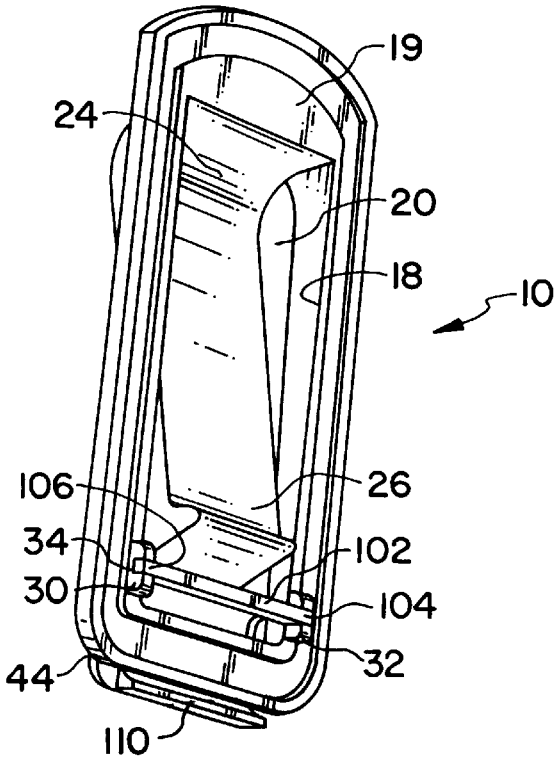
FIG. 5 is a plan view of the backside illustrating the first and second extensions which provide for pivotal engagement of the locking unit to the supporting body.

FIG. 2 illustrates the locking clasp 10 from the rear view. The supporting body 12 has a back side 19. The distal end 26 of the clasping arm 22 extends through the slot 20 defined by the inner perimeter 18 of the supporting body 12. The back side 19 has a first extension 30 and second extension 32 which each are shaped so as to define a first groove 34 (not shown) and a second groove 36. The first and second extensions 30 and 32 project from the bottom portion 16 of the supporting body 12. FIG. 5 illustrates the shape of the first and second extensions 30 and 32 which define the first and second grooves 34 and 36 (not shown). A more detailed description of the extensions 30 and 32 and the grooves 34 and 36 is provided hereinafter.

Figure 3:
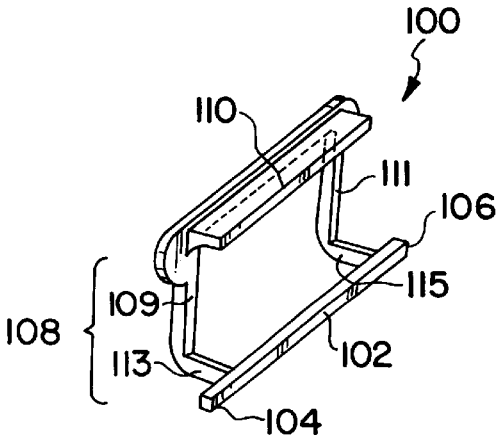
FIG. 3 is a plan view of the locking unit.
Figure 4:
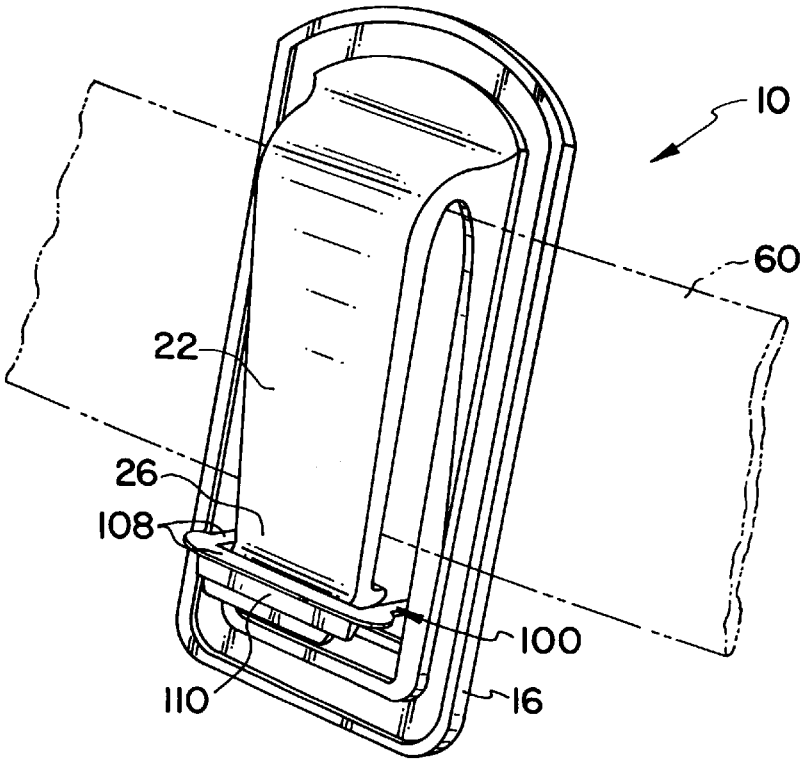
FIG. 4 is a plan view of the locking clasp in locked position used with a belt.

Referring now to FIG. 3, the locking unit 100 comprises an engaging rod 102 which has a first engaging end 104 and a second engaging end 106. The locking unit 100 has a locking portion 108. Locking portion 108 is comprised of two vertical legs 109 and 111, that are connected at their lower ends to rod 102 by horizontal legs 113 and 115, respectively, while their upper ends are connected to a horizontal member 117 to which an elongated guidance flange 110 is connected and from which guidance flange 110 projected rearwardly in the same direction as engaging rod 102. The elongated nature of guidance flange 110 provides no only additional strength for the locking portion 108 but also an elongated engagement surface. The guidance flange 110 assists in securing the locking unit 100 to the supporting body 12 when the locking unit 100 is in the unlocked position as is illustrated in FIGS. 2 and 4. The guidance flange 110 engages the bottom surface 44 of the bottom portion 16 of the supporting body 12 to support and secure the locking unit 100 when in the unlocked position.

Referring now to FIG. 4, the locking clasp 10 is illustrated in the locked position. The locking unit 100 is pivoted so as to be above the distal end 26 of the clasping arm 22. In this position, when a belt or other object 60 is within the locking clasp 10, if the clasping arm 22 is flexed towards the open position, the locking portion 108 of the locking unit 100 stops the motion, thereby locking the clasp 10 to prevent the object or belt 60 from being removed from the clasp 10.

FIG. 5 illustrates the first and second extensions 30 and 32 which define the first and second grooves 34 and 36. The extensions 30 and 32 project from the bottom portion 6 of the back side 19. The extensions 30 and 32 project from portions of the back side 19 which are located near to the inner perimeter 8 which defines the slot 20. Other configurations for these extensions 30 and 32 and grooves 34 and 36 are contemplated which provide for attachment of the locking unit 100 to the supporting body 12 with pivotal movement between the two. Any structure which allows pivotal attachment is sufficient.

The operation of the invention involves positioning the locking unit 100 in the unlocked position as illustrated in FIGS. 1 and 5. The clasping arm 22 is flexed open to provide a passage way for a belt or object 60 to pass under the clasping arm 22 and into the locking clasp 10 as is illustrated in FIG. 4. The locking unit 100 is then pivoted or rotated to locate the locking portion 108 over the distal end 26 of the clasping arm 22. Accordingly, the locking portion 108 prevents the opening of the clasping arm 22 when the locking unit 100 is in the locked position.

Although the description above contains many details, these should not be construed as limiting the scope of the invention but as merely providing illustrations of some of the presently preferred embodiments of this invention. For example, the locking unit may have various shapes and sizes, yet still provide the necessary pivotal and locking capability; the manner in which the locking unit is pivotally connected to the supporting body may be altered and varied without departing from the spirit of this invention; or the guidance flange may be other configurations, such as a plurality of separate guidance flanges which provide similar functionality.

Thus the scope of the invention should be determined by the appended claims and their legal equivalents, rather than by the examples given.

What is claimed is:

1. A belt clasp which locks onto a belt or the like comprising:

a supporting body having a top portion, a back side, and an inner perimeter defining a slot;

a clasping arm flexibly attached to the top portion of the supporting body and extending into the slot; and a locking unit pivotally attached to the back side;

the locking unit shaped such that when the locking unit is in a locked position, the locking unit prevents a distal end of the clasping arm from flexing open, thus locking the clasp onto the belt.

2. The belt clasp of claim 1, further comprising:

the back side having a first and second extension, each defining a first and second engaging groove, respectively.

3. The belt clasp of claim 2, further comprising:

the locking unit having an engaging rod which has first and second engaging ends and a locking portion, the engaging ends shaped such that when engaged to the first and second engaging grooves, the locking unit is pivotally attached to the back side so as to provide a locked position and an unlocked position.

4. The belt clasp of claim 3, further comprising:

the locking portion shaped such that when the locking unit is in a locked position, the locking portion prevents a distal end of the clasping arm from flexing open, thus locking the clasp onto a belt.

5. The belt clasp of claim 4, further comprising:

a guidance flange extending from the locking portion of the locking unit;

the guidance flange shaped so as to provide stability to the locking unit by engaging the supporting body when the locking unit is in the unlocked position.

6. The belt clasp of claim 1, wherein the clasping arm extends away from the top portion of the supporting body and in an arcing manner turns back towards the supporting body and extends into the slit.

7. A belt clasp which locks onto a belt or the like comprising:

a supporting body having a top portion, a back side, and an inner perimeter defining a slot;

said supporting body having a front supporting side and a bottom portion;

a clasping arm flexibly attached to the top portion of the supporting body and extending into the slot; and a locking unit pivotally attached to the back side;

the locking unit shaped such that when the locking unit is in a locked position, the locking unit prevents a distal end of the clasping arm from pivoting open, thus locking the clasp onto a belt.

8. The belt clasp of claim 7, further comprising:

said clasping arm having an attached end and a distal end, the clasping arm flexibly attached at its attached end to the front supporting side of the top portion of the supporting body, and the clasping arm distal end extending into the slot.

9. The belt clasp of claim 8, further comprising:

said engaging rod having a first and second end, and shaped so as to engage said first and second engaging grooves, respectively, such that the locking unit is pivotally connected to the supporting body to provide a locked position and an unlocked position.

10. The belt clasp of claim 9, further comprising:

the locking unit having a locking portion shaped such that when the locking unit is in a locked position, the locking portion prevents a distal end of the clasping arm from flexing open, thus locking the clasp onto the belt.

11. The belt clasp of claim 10, further comprising:

a guidance flange extending from the locking portion of the locking unit;

the guidance flange shaped so as to provide stability to the locking unit by engaging the supporting body when the locking unit is in the unlocked position.

12. A belt clasp which locks onto a belt or the like comprising:

a supporting body having a top portion, a back side, and an inner perimeter defining a slot;

a clasping arm flexibly attached to the top portion of the supporting body and extending into the slot;

said clasping arm and supporting body formed so as to receive a belt and removably attach the belt clasp to the belt;

a locking unit pivotally attached to the back side; and the locking unit shaped such that when the locking unit is in a locked position, the locking unit prevents a distal end of the clasping arm from flexing open, thus locking the clasp onto the belt.

13. A belt clasp which locks onto a belt or the like comprising:

a supporting body having a top portion, a back side, and an inner perimeter defining a vertically extending slot;

a clasping arm flexibly attached in a non-pivoting manner to the top portion of the supporting body, said clasping arm having a distal end extending into the slot, said supporting body and clasping arm comprising a unitary molded piece; and a locking unit pivotally attached to the back side;

the locking unit shaped such that when the locking unit is in a locked position, the locking unit prevents the distal end of the clasping arm from flexing open, thus locking the clasp onto the belt.

14. A belt clasp which locks onto a belt or the like comprising:

a supporting body having a top portion, a back side, a front supporting side, a bottom portion and an inner perimeter defining a vertically extending slot;

a clasping arm flexibly attached in a non-pivoting manner to the top portion of the supporting body, said clasping arm having a free distal end extending into the slot, said supporting body and clasping arm comprising a unitary molded piece; and a locking unit pivotally attached to the back side and extending through the slot;

the locking unit shaped such that when the locking unit is in a locked position, the locking unit prevents the distal end of the clasping arm from pivoting open, thus locking the clasp onto a belt.

15. The belt clasp of claim 6, further comprising:

said back side having a first and second extension, each extension extending from the bottom portion of the back side, the first and second extensions each defining a first and second engaging groove, respectively.

* * * * *